US009197009B2

(12) United States Patent
Nagasaka et al.

(10) Patent No.: US 9,197,009 B2
(45) Date of Patent: Nov. 24, 2015

(54) CONNECTION TERMINAL

(75) Inventors: Naokazu Nagasaka, Shizuoka (JP); Takumi Nakagishi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 13/984,194

(22) PCT Filed: Mar. 27, 2012

(86) PCT No.: PCT/JP2012/057989

§ 371 (c)(1),
(2), (4) Date: Aug. 7, 2013

(87) PCT Pub. No.: WO2012/133444

PCT Pub. Date: Oct. 4, 2012

(65) Prior Publication Data

US 2013/0316562 A1 Nov. 28, 2013

(30) Foreign Application Priority Data

Mar. 30, 2011 (JP) ..... 2011-075926

(51) Int. Cl.
*H01R 11/22* (2006.01)
*H01R 13/62* (2006.01)
*H01R 13/422* (2006.01)

(52) U.S. Cl.
CPC ..... *H01R 13/62* (2013.01); *H01R 13/4223* (2013.01)

(58) Field of Classification Search
CPC .... H01R 13/4223; H01R 13/62; H01R 13/42; H01R 13/113
USPC ..... 439/839–862
See application file for complete search history.

(56) References Cited

U.S. PATENT DOCUMENTS 5,593,328 A * 1/1997 Okada et al. ..... 439/851
6,767,259 B2 * 7/2004 Kojima et al. ..... 439/752
7,458,863 B2 * 12/2008 Shimizu ..... 439/842

(Continued)

FOREIGN PATENT DOCUMENTS

JP 2003-77574 A 3/2003
JP 2007-141609 A 6/2007

(Continued)

OTHER PUBLICATIONS

International Search Report and Written Opinion of the International Search Report for PCT/JP2012/057989 dated May 29, 2012.
Written Opinion of the International Searching Authority for PCT Patent App. No. PCT/JP2012/057989 (May 29, 2012).

(Continued)

*Primary Examiner* — Briggitte R Hammond
(74) *Attorney, Agent, or Firm* — Kenealy Vaidya LLP

(57) ABSTRACT

A connection terminal includes a terminal fitting part that fits with a leading end portion of a mating connection terminal, a square tubular part that continues to a rear end of the terminal fitting part and a lance engagement surface that is formed on the square tubular part and that, when the connection terminal is inserted into a terminal accommodation hole of a connector housing, is contacted to a projected part of a lance provided in the terminal accommodation hole to prevent the connection terminal from disengaging from the terminal accommodation hole. The lance engagement surface is a hook-shaped engagement surface that is formed by an opening across a top wall of the square tubular part facing the lance and a sidewall part continuing to a side edge of the top wall.

3 Claims, 12 Drawing Sheets

(56) References Cited

U.S. PATENT DOCUMENTS

| | | | |
|---|---|---|---|
| 2003/0096533 | A1 | 5/2003 | Kojima et al. |
| 2007/0111599 | A1 | 5/2007 | Tanaka |

FOREIGN PATENT DOCUMENTS

| | | | |
|---|---|---|---|
| JP | 2007-287615 | A | 11/2007 |
| JP | 2008-153074 | A | 7/2008 |
| JP | 2009-104863 | A | 5/2009 |

OTHER PUBLICATIONS

Japanese Office Action for the related Japanese Patent Application No. 2011-075926 dated Dec. 9, 2014.

Korean Office Action for the related Korean Patent Application No. 10-2013-7025851 dated Sep. 18, 2014.

Chinese Office Action for the related Chinese Patent Application No. 201280015879.6 dated Apr. 1, 2015.

Japanese Office Action for the related Japanese Patent Application No. 2011-075926 dated Jun. 2, 2015.

* cited by examiner

CONNECTION TERMINAL

TECHNICAL FIELD

The invention relates to a connection terminal that is prevented from disengaging by a lance provided to a connector housing when the terminal is accommodated in a terminal accommodation hole of the connector housing.

BACKGROUND ART

FIG. 11 shows an example of the related art of a connection terminal 110 that is kept in a connector housing 101. The connection terminal 110 is disclosed in PTL1. The connection terminal 110 is kept with being accommodated in a terminal accommodation hole 102 of the connector housing 101.

The connector housing 101 is provided with a lance 103 in the terminal accommodation hole 102. The lance 103 has a configuration where a projected part 103*b* protruding towards a center in the terminal accommodation hole 102 is provided to a leading end of a cantilever-shaped elastic piece 103*a* extending a longitudinal direction of the terminal accommodation hole 102.

The connection terminal 110 is a female terminal that is formed by press-molding a metal plate. The connection terminal 110 has a square tube-shaped terminal fitting part 111 that fits with a leading end portion of a mating connection terminal, a square tubular part 112 that continues to a rear end of the terminal fitting part 111, a wire crimping part 113 that continues to a rear end of the square tubular part 112 and a lance engagement surface 114 that is formed on the square tubular part 112. In the meantime, a left side of FIG. 11 is referred to as a front side and a right side of FIG. 11 is referred to as a rear side.

As shown in FIG. 12, the lance engagement surface 114 is a portion of a front edge part 115*a* in an opening 115 that is formed across a top wall 112*a* of the square tubular part 112 facing the lance 103 and both sidewall parts 112*b*, 112*c* continuing to both edges of the top wall 112*a*.

The lance engagement surface 114 faces a leading end portion of the projected part 103*b* fitted into the opening 115. In the related art, as shown in FIG. 12, a width size W1 of the projected part 103*b* of the lance 103 is set to be smaller than a width size W2 of the top wall 112*a*. Therefore, a range corresponding to the width size W1 in the front edge part 115*a* of the opening 115 functions as the lance engagement surface 114.

When a tensile load is applied to the connection terminal 110 in a disengaging direction with the connection terminal 110 being mounted in the terminal accommodation hole 102, the lance engagement surface 114 is contacted to the projected part 103*b* to thus prevent disengagement.

CITATION LIST

Patent Literature

PTL1: JP-A-2007-141609

SUMMARY OF INVENTION

Technical Problem

However, like PTL1, according to the connection terminal 110 of the related art in which a part of the width of the top wall 112*a* having a substantial flat plate shape is set as the lance engagement surface 114, the lance engagement surface 114 has a simple linear shape along a plate thickness of the top wall 112*a*. Therefore, in order to increase an engaging strength when the lance engagement surface 114 is pressed to the projected part 103*b*, the plate thickness of the top wall 112*a* is necessarily increased.

In other words, in order to improve a holding force of the connection terminal 110 in the connector housing 101, the connection terminal 110 should be made to be thicker. In this case, the cost of the connection terminal is increased due to the thickening, which is problematic.

Therefore, an object of the invention relates to a solution of the above problem and is to provide a connection terminal capable of increasing an engaging strength for preventing disengagement between a lance of a connector housing and the connection terminal and implementing improvement on a holding force of the connection terminal in the connector housing at low cost.

Solution to Problem

The above object of the invention is achieved by following configurations.

(1) A connection terminal includes a terminal fitting part that fits with a leading end portion of a mating connection terminal; a square tubular part that continues to a rear end of the terminal fitting part, and a lance engagement surface that is formed on the square tubular part and that, when the connection terminal is inserted into a terminal accommodation hole of a connector housing, is contacted to a projected part of a lance provided in the terminal accommodation hole to thereby prevent the connection terminal from disengaging from the terminal accommodation hole, wherein the lance engagement surface is a hook-shaped engagement surface that is formed by an opening across a top wall of the square tubular part facing the lance and a sidewall part continuing to a side edge of the top wall and that has a first engagement surface, which is an edge part of the opening of the top wall, and a second engagement surface, which is an edge part of the opening of the sidewall part and extends in a direction substantially orthogonal to the top wall from an end of the first engagement surface.

(2) In the connection terminal described in the above (1), the terminal fitting part has a square tubular structure to which a tab of the mating connection terminal is fittable.

(3) In the connection terminal described in the above (1), the terminal fitting part is a tab that is fittable to a terminal fitting part having a square tubular structure of the mating connection terminal.

According to the above configuration (1), the lance engagement surface is a hook-shaped engagement surface having a first engagement surface, which is an edge part of the opening of the top wall, and a second engagement surface, which is an edge part of the opening of the sidewall part and extends in a direction substantially orthogonal to the top wall from an end of the first engagement surface.

The connection terminal having the hook-shaped lance engagement surface has an increased contact area with the projected part of the lance and an improved mechanical strength owing to the hook shape structure, compared to a connection terminal of the related art having a linear lance engagement surface using only a portion of an edge part of the opening of the top wall. Therefore, it is possible to increase an engaging strength upon the engagement with the lance, without increasing a plate thickness of the connection terminal.

Accordingly, it is possible to increase the engaging strength for preventing disengagement between the lance of the connector housing and the connection terminal without thickening the connection terminal. Also, it is possible to improve a holding force of the connection terminal in the connector housing at low cost.

According to the above configuration (2), the connection terminal is a female terminal having the terminal fitting part to which a tab of the mating connection terminal is fitted. With the female terminal, it is possible to increase the engaging strength for preventing the disengagement between the lance of the connector housing and the connection terminal and to improve the holding force of the connection terminal in the connector housing at low cost, without thickening the connection terminal.

According to the above configuration (3), the connection terminal is a male terminal having the terminal fitting part that is a tab. With the male terminal, it is possible to increase the engaging strength for preventing the disengagement between the lance of the connector housing and the connection terminal and to improve the holding force of the connection terminal in the connector housing at low cost, without thickening the connection terminal.

According to the connection terminal of the invention, the lance engagement surface has the hook shape, so that an increased contact area with the projected part of the lance is increased and a mechanical strength is also improved owing to the hook shape structure, compared to a connection terminal of the related art having a linear lance engagement surface. Therefore, it is possible to increase an engaging strength upon the engagement with the lance, without increasing a plate thickness of the connection terminal.

Accordingly, it is possible to increase the engaging strength for preventing disengagement between the lance of the connector housing and the connection terminal without thickening the connection terminal. Also, it is possible to improve a holding force of the connection terminal in the connector housing at low cost.

DESCRIPTION OF EMBODIMENTS

Hereinafter, a preferred illustrative embodiment of a connector of the invention will be specifically described with reference to the drawings.

FIGS. 1 to 10 show an illustrative embodiment of a male tab terminal and a female connection terminal, which are the connection terminals of the invention.

Figure 1:
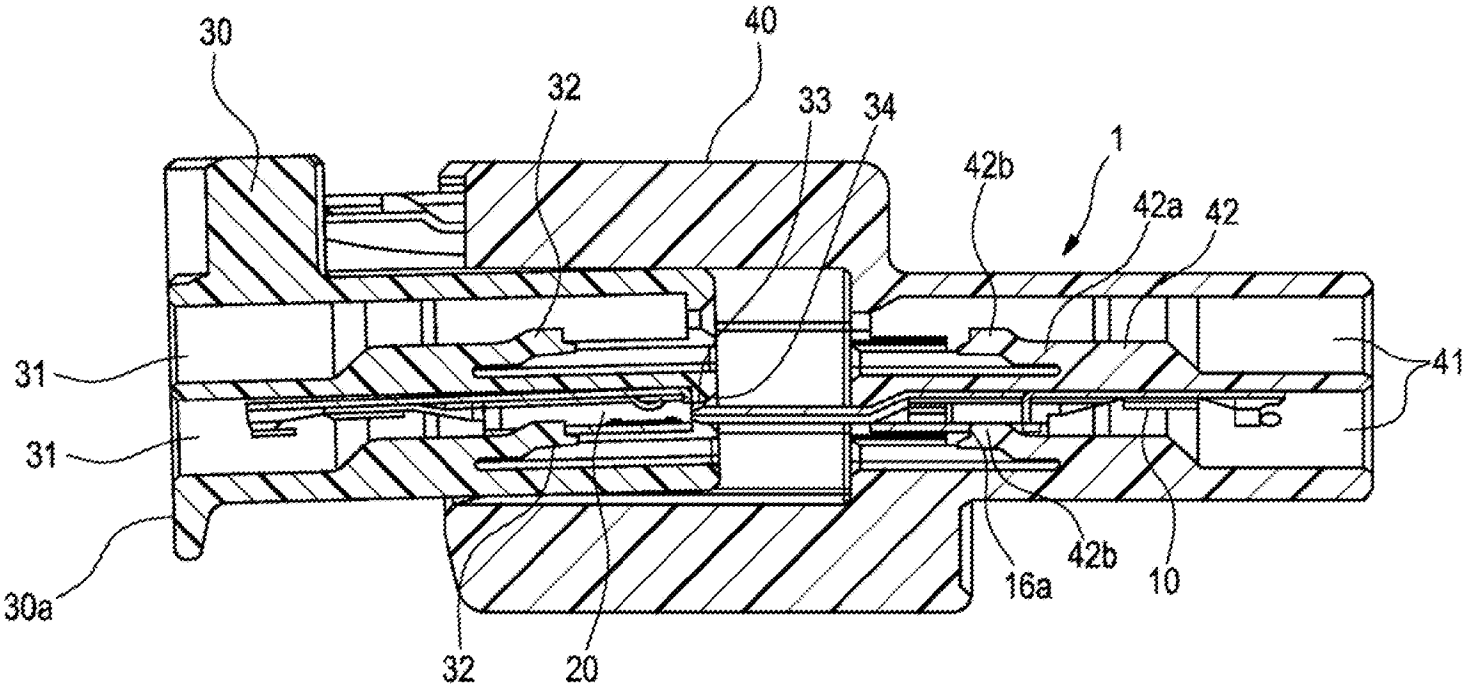
FIG. 1 is a longitudinally sectional view of a connector accommodating a correction terminal according to an illustrative embodiment of the invention.
Figure 2:
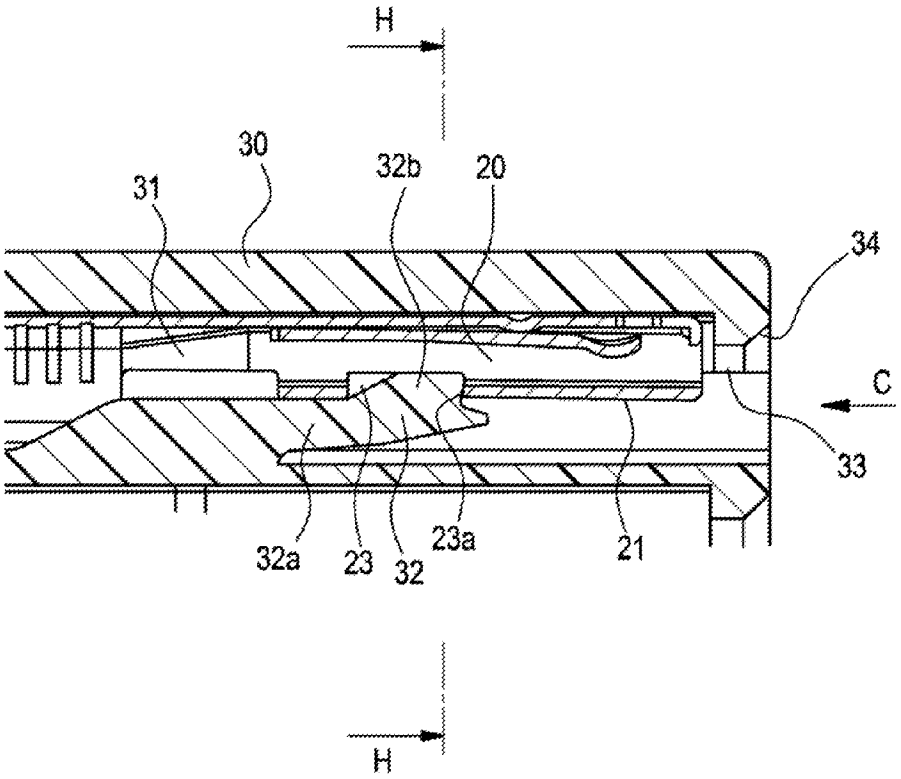
FIG. 2 is an enlarged view showing a holding structure of a connection terminal in a female connector housing shown in FIG. 1.
Figure 3:
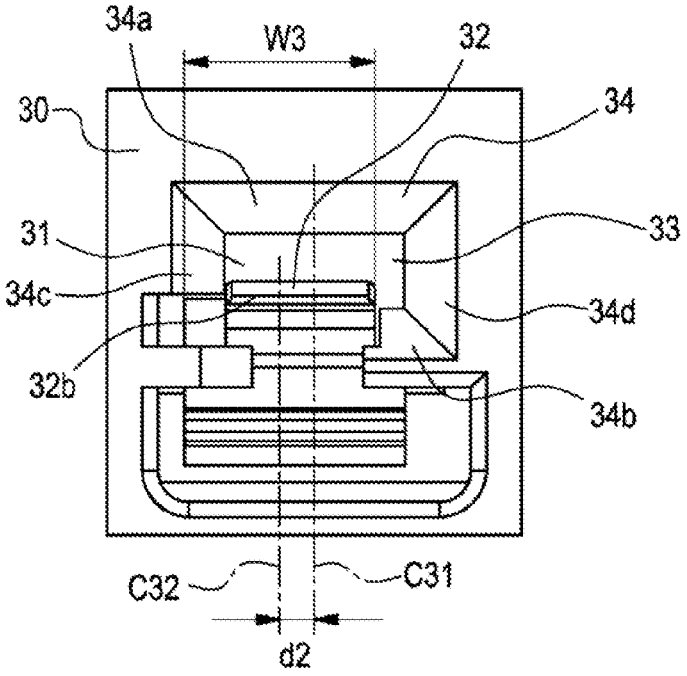
FIG. 3 is a view seen from an arrow C direction of FIG. 2.
Figure 4:
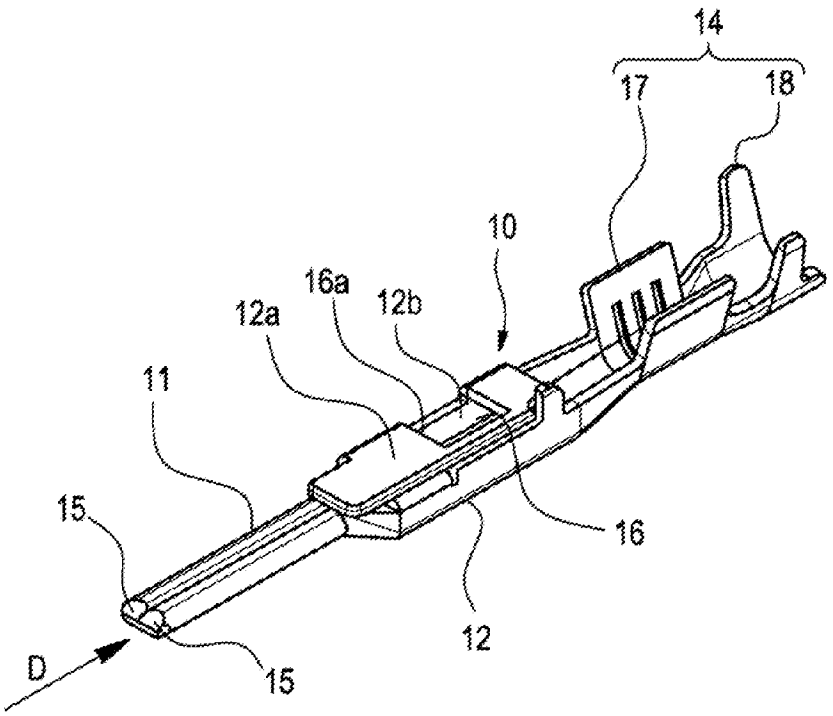
FIG. 4 is a perspective view of a male tab terminal shown in FIG. 1.
Figure 5:
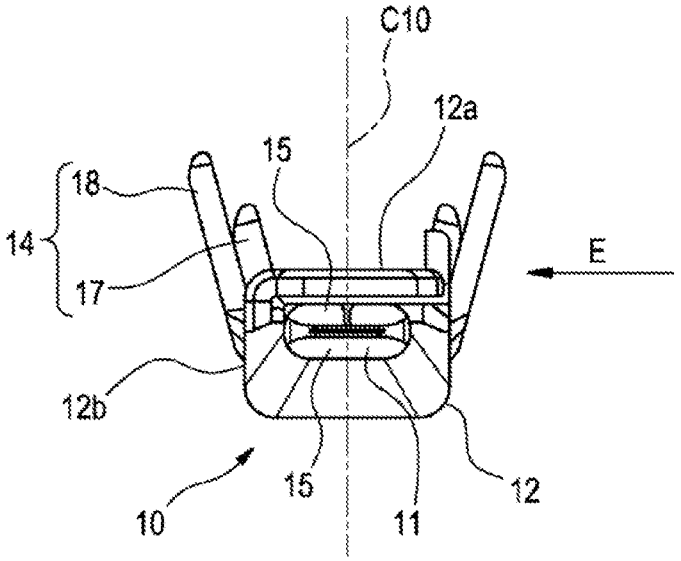
FIG. 5 is a view seen from an arrow D direction of FIG. 4.
Figure 6:
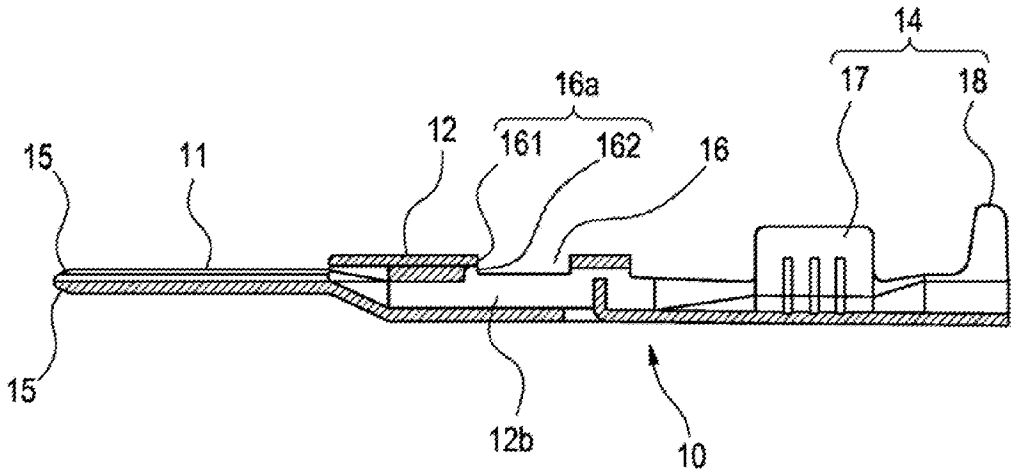
FIG. 6 is a side sectional view of the male tab terminal shown in FIG. 4 (a sectional view seen from an arrow E direction of FIG. 5).
Figure 7:
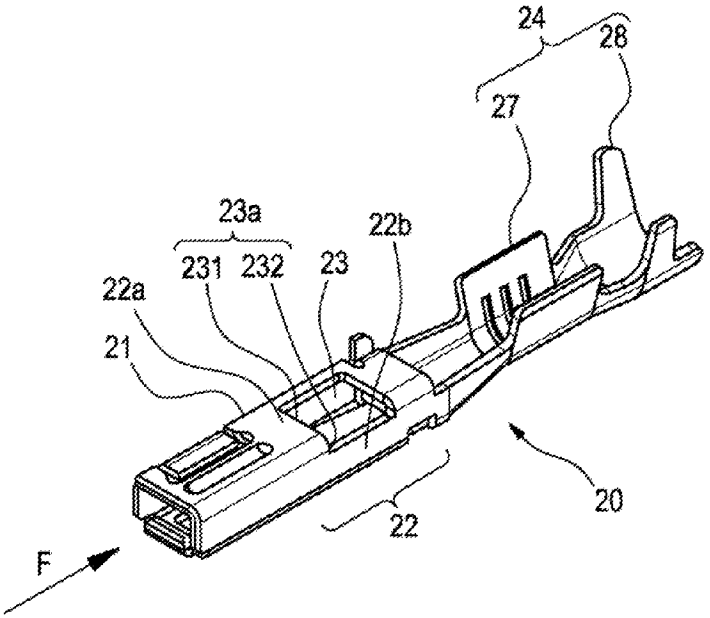
FIG. 7 is a perspective view of a female connection terminal shown in FIG. 1.
Figure 8:
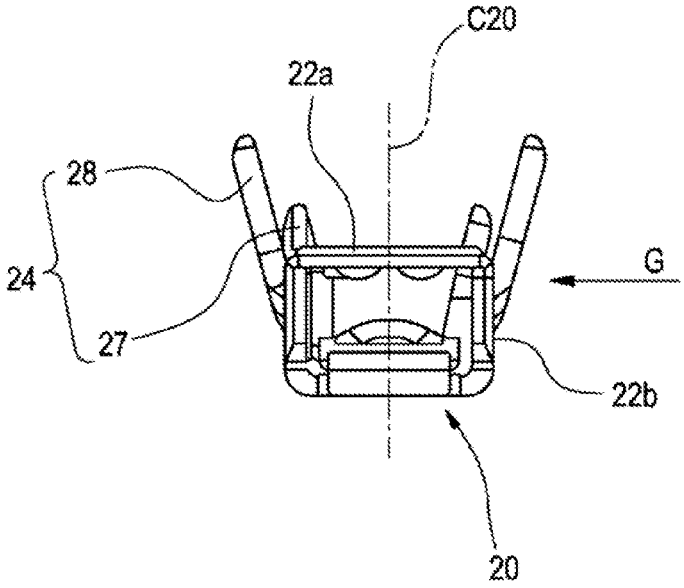
FIG. 8 is a view seen from an arrow F direction of FIG. 7.
Figure 9:
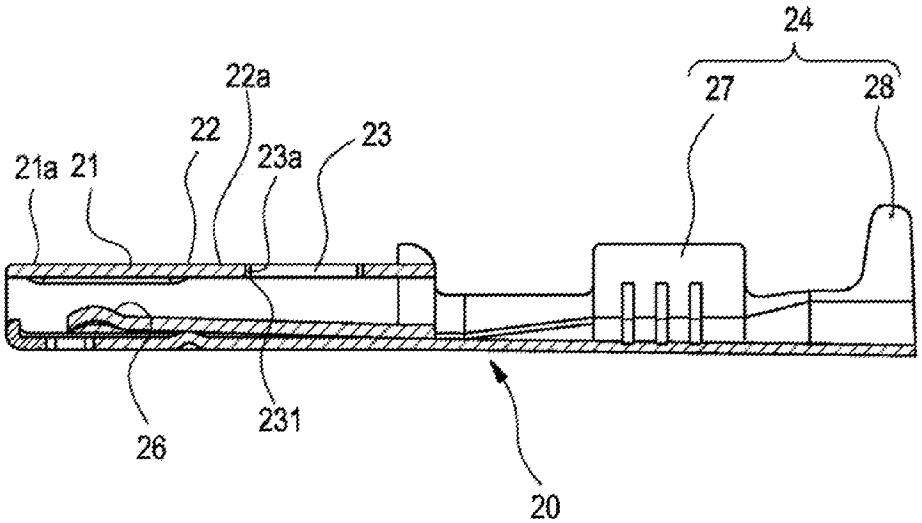
FIG. 9 is a side sectional view of the female connection terminal shown in FIG. 7 (a sectional view seen from an arrow G direction of FIG. 5).
Figure 10:
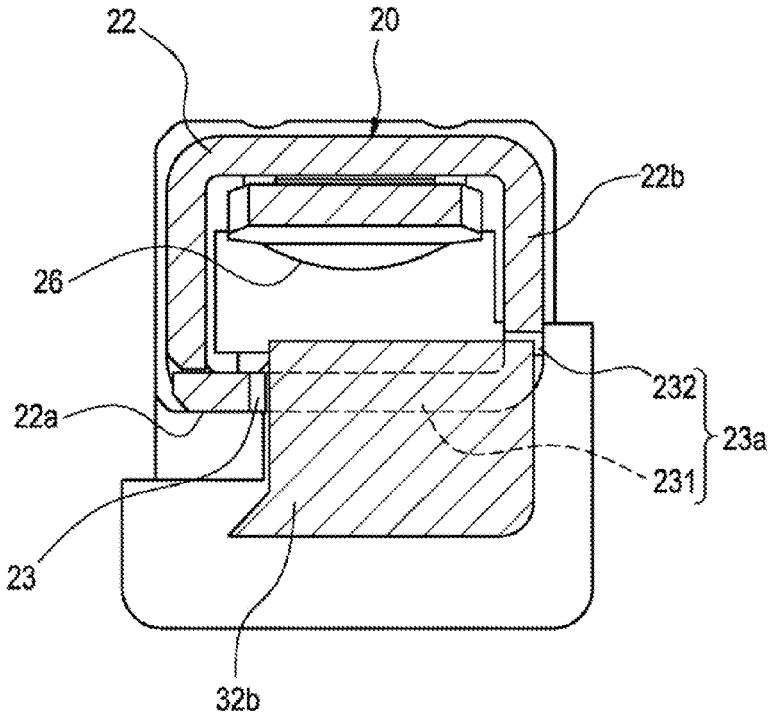
FIG. 10 is an H-H sectional view of FIG. 2.
Figure 11:
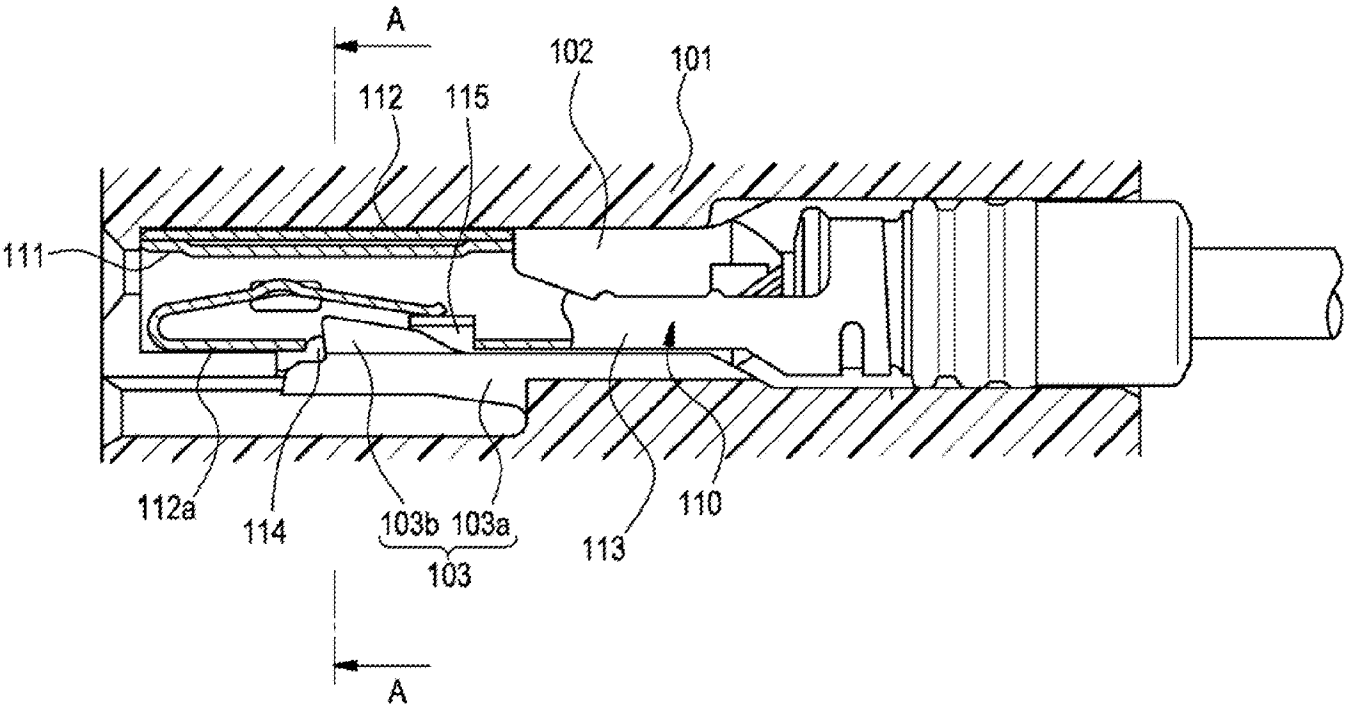
FIG. 11 Related Art
FIG. 11 is a partial sectional view illustrating a state where a connection terminal of the related art is held in a connector housing.

FIG. 1 is a longitudinally sectional view of a connector accommodating a correction terminal according to an illustrative embodiment of the invention, FIG. 2 is an enlarged view showing a holding structure of a connection terminal in a female connector housing shown in FIG. 1, FIG. 3 is a view seen from an arrow C direction of FIG. 2, FIG. 4 is a perspective view of a male tab terminal shown in FIG. 1, FIG. 5 is a view seen from an arrow D direction of FIG. 4, FIG. 6 is a side sectional view of the male tab terminal shown in FIG. 4 (a sectional view seen from an arrow E direction of FIG. 5), FIG. 7 is a perspective view of a female connection terminal shown in FIG. 1, FIG. 8 is a view seen from an arrow F direction of FIG. 7, FIG. 9 is a side sectional view of the female connection terminal shown in FIG. 7 (a sectional view seen from an arrow G direction of FIG. 5) and FIG. 10 is an H-H sectional view of FIG. 2.

A connector 1 shown in FIG. 1 has a male tab terminal 10, a female connection terminal 20, a female housing 30 serving as a first housing that accommodates and holds therein the female connection terminal 20 and a male housing 40 serving as a second housing that accommodates and holds therein the male tab terminal 10 and is fittingly connected to the first housing.

The male tab terminal 10 is a press molded product of a metal plate, and has, as shown in FIGS. 4 to 6, a rod-shaped tab 11 that is formed at a leading end thereof (a left end, in FIG. 6), a square tubular part 12 of a square tubular structure continuing to a rear end of the tab 11 and a wire crimping part 14 continuing to a rear end of the square tubular part 12. In the meantime, a left side of FIG. 6 is referred to as a front side and a right side of FIG. 6 is referred to as a rear side.

A leading end portion of the tab 11 is provided with a chamfering 15 so as to easily fit with the female connection terminal 20 that will be described later.

A top wall 12*a* of the square tubular part 12 is formed with a lance engagement hole 16 serving as a second lance engagement part with which a projected part 42*b* of a male terminal engagement lance 42, which will be described later, is engaged.

The lance engagement hole 16 is a substantially quadrangular opening, is not symmetrically formed with respect to a central axis C10 of the male tab terminal 10 shown in FIG. 5 and is formed eccentrically in a width direction (refer to FIG. 4). Also, in this illustrative embodiment, the lance engagement hole 16 is formed so that the projected part 42*b* of the male terminal engagement lance 42, which will be described later, is also engageable with one sidewall part 12*b* of the square tubular part 12. That is, the lance engagement hole 16 is formed by an opening (notch) across the top wall 12*a* of the square tubular part 12 facing the male terminal engagement lance 42, which will be described later, and sidewall parts 12*b* continuing to side edges of the top wall 12*a*.

An edge part of the lance engagement hole 16 at the leading end-side becomes a lance engagement surface 16*a* that contacts the projected part 42*b* of the male terminal engagement lance 42 to thus prevent disengagement.

In this illustrative embodiment, as shown in FIGS. 4 and 6, the lance engagement surface 16*a* is a hook-shaped (L-shaped) engagement surface having a first engagement surface 161, which is an edge part of the opening of the top wall 12*a*, and a second engagement surface 162, which is an edge part of the opening of the sidewall parts 12*b* and extends in a direction substantially orthogonal to the top wall 12*a* from an end of the first engagement surface 161.

The wire crimping part 14 has a conductor caulking piece 17 that is crimped to a conductor of a wire and a covering caulking piece 18 that is caulked to a covering of the wire.

The female connection terminal 20 is a press molded product of a metal plate, and has, as shown in FIGS. 7 to 9, a square tube-shaped terminal fitting part 21 that is formed at a leading end thereof (a left end, in FIG. 9), a square tubular part 22 of a square tubular structure continuing to a rear end of the terminal fitting part 21 and a wire crimping part 24 continuing to a rear end of the square tubular part 22. In the meantime, a left side of FIG. 9 is referred to as a front side and a right side of FIG. 9 is referred to as a rear side.

In this illustrative embodiment, the square tubular part 22 has a square tubular structure extending from the rear end-side of the terminal fitting part 21. A top wall 22*a* of the square tubular part 22 is formed with a lance engagement hole 23 serving as a lance engagement part with which a projected part 32*b* of a female terminal engagement lance 32, which will be described later, is engaged.

The terminal fitting part 21 has a square tubular structure to which the tab 11 of the leading end of the male tab terminal 10 is fittable, and the tab 11 is fittingly connected thereto. As shown in FIG. 9, the terminal fitting part 21 is provided therein with a press spring piece 26 that presses the inserted tab 11 towards an upper surface 21*a* to thus implement conduction connection with the tab 11.

The lance engagement hole 23 is a lance engagement part with which the projected part 32*b* of the female terminal engagement lance 32 of the female housing 30, which will be described below, is engaged. The lance engagement hole 23 is a substantially quadrangular opening, is not symmetrically formed with respect to a central axis C20 of the female connection terminal 20 shown in FIG. 8 and is formed eccentrically in a width direction. Also, in this illustrative embodiment, the lance engagement hole 23 is formed so that the projected part 32*b* of the female terminal engagement lance 32, which will be described later, is also engageable with one sidewall part 22*b* of the square tubular part 22. That is, the lance engagement hole 23 is formed by an opening (notch) across the top wall 22*a* of the square tubular part 22 facing the female terminal engagement lance 32, which will be described later, and sidewall parts 22*b* continuing to side edges of the top wall 22*a*.

An edge part of the lance engagement hole 26 at the leading end-side becomes a lance engagement surface 23*a* that contacts the projected part 32*b* of the female terminal engagement lance 32 to thus prevent disengagement.

In this illustrative embodiment, as shown in FIGS. 7 and 10, the lance engagement surface 23*a* is a hook-shaped (L-shaped) engagement surface having a first engagement surface 231, which is an edge part of the opening of the top wall 22*a*, and a second engagement surface 232, which is an edge part of the opening of the sidewall parts 22*b* and extends in a direction substantially orthogonal to the top wall 22*a* from an end of the first engagement surface 231.

The wire crimping part 24 has a conductor caulking piece 27 that is crimped to a conductor of a wire and a covering caulking piece 28 that is caulked to a covering of the wire.

The female housing 30 is an injection molded product of a plastic material, and has a female terminal accommodation hole 31, a female tell signal engagement lance 32, a tab insertion hole 33 and a taper-shaped guide surface 34, as shown in FIGS. 1 to 3.

The female terminal accommodation hole 31 is a hole that accommodates therein the female connection terminal 20. The female terminal accommodation hole 31 opens to a rear end surface (base end surface) of the female housing 30 and the female connection terminal 20 is inserted therein from a rear end of the housing.

As shown in FIG. 2, the female terminal engagement lance 32 has an elastic piece 32*a* that is provided in the female terminal accommodation hole 31 and extends in a longitudinal direction of the female terminal accommodation hole 31 and a projected part 32*b* that protrudes from the elastic piece 32*a* towards a center of the female terminal accommodation hole 31. The lance engagement surface 23*a* of the female connection terminal 20 and the projected part 32*b* are contacted, so that the female terminal engagement lance 32 prevents the female connection terminal 20 from disengaging.

The tab insertion hole 33 is a hole having a quadrangular cross section that is formed to penetrate a housing leading end so as to insert the tab 11 into the terminal fitting part 21 of the female connection terminal 20 held in the female terminal accommodation hole 31. The tab insertion hole 33 communicates with the female terminal accommodation hole 31.

The taper-shaped guide surface 34 is a taper surface that, when a leading end of the tab 11 contacts thereto, guides the contacting tab 11 towards a center of the tab insertion hole 33. As shown in FIG. 3, the taper-shaped guide surface 34 has four guide surfaces 34*a*, 34*b*, 34*c*, 34*d* corresponding to four sides of opening edges of the tab insertion hole 33. The guide surface 34*a* is a taper surface that continues to an upper side of the opening edge of the tab insertion hole 33. The guide surface 34*b* is a taper surface that continues to a lower side of the opening edge of the tab insertion hole 33. The guide surface 34*c* is a taper surface that continues to a left side (a side positioned at the left side of FIG. 3) of the opening edge of the tab insertion hole 33. The guide surface 34*d* is a taper surface that continues to a right side (a side positioned at the right side of FIG. 3) of the opening edge of the tab insertion hole 33.

In this illustrative embodiment, as shown in FIG. 3, the projected part 32*b* of the female terminal engagement lance 32 has a width W3 in a terminal width direction. A central axis C32 of the projected part 32*b* (the female terminal engagement lance 32) is formed eccentrically in a widthwise left side (the left side in FIG. 3) of the female connection terminal 20 with respect to a central axis C31 of the female terminal accommodation hole 31. Therefore, as shown in FIG. 3, a positional deviation of a size d2 is caused between the central axis C32 and the central axis C31.

In this illustrative embodiment, the lance engagement hole 23 of the female connection terminal 20 with which the projected part 32*b* of the female terminal engagement lance 32 is engaged is provided eccentrically in the terminal width direction from the central axis C20 of the female connection terminal 20 shown in FIG. 8, in correspondence to the eccentricity amount d2 of the central axis C32 with respect to the central axis C31.

As shown in FIG. 1, the male housing 40 has a male terminal accommodation hole 41 that accommodates therein the male tab terminal 10 and a male terminal engagement lance 42 that faces the male terminal accommodation hole 41.

The male terminal engagement lance 42 has an elastic piece 42*a* that extends in a longitudinal direction of the male terminal accommodation hole 41 and a projected part 42*b* that protrudes from the elastic piece 42*a* towards the male terminal accommodation hole 41. The projected part 42*b* is engaged with the lance engagement surface 16*a* of the male tab terminal 10, so that the male terminal engagement lance 42 prevents the male tab terminal 10 from disengaging.

In this illustrative embodiment, although not shown, like the female terminal engagement lance 32 of the female housing 30, the male terminal engagement lance 42 is formed eccentrically in a width direction of the male tab terminal 10 with respect to a central axis of the male terminal accommodation hole 41.

In this illustrative embodiment, as described above, the lance engagement hole 16 of the male tab terminal 10, which is the second lance engagement part with which the male terminal engagement lance 42 is engaged, is provided eccentrically in the terminal width direction from the central axis of the male tab terminal 10. An eccentricity amount of the lance engagement hole 16 corresponds to the eccentricity amount d2 of the male terminal engagement lance 42 with respect to the male terminal accommodation hole 41.

In the male tab terminal 10 or female connection terminal 20 as described above, the lance engagement surfaces 16*a*, 23*a* have hook shapes having the first engagement surfaces 161, 231, which are the edge parts of the openings of the top walls 12*a*, 22*a* of the square tubular parts 12, 22, and the second engagement surfaces 162, 232, which are the edge parts of the openings of the sidewall parts 12*b*, 22*b* and extend in the direction substantially orthogonal to the top walls 12*a*, 22*a* from the ends of the first engagement surfaces 161, 231.

Figure 12:
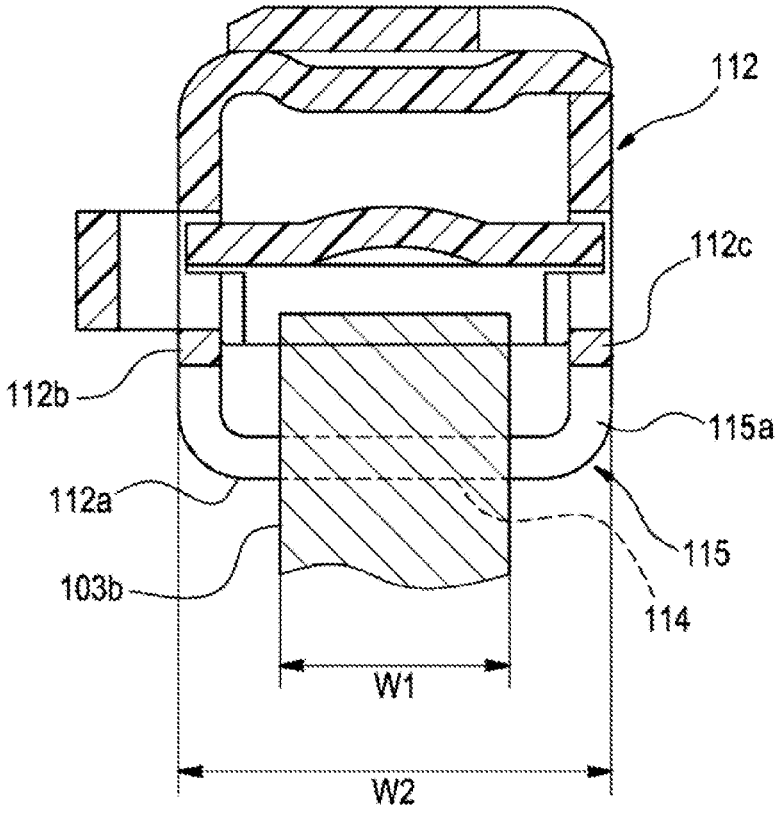
FIG. 12 is an A-A sectional view of FIG. 11.

The connection terminals 10, 20 having the hook-shaped lance engagement surfaces 16*a*, 23*a* have the increased contact areas with the projected parts 32*b*, 42*b* of the lances 32, 42 and the improved mechanical strength (buckling strength) owing to the hook shape structure, compared to the connection terminal of the related art having the linear lance engagement surface (refer to FIG. 12) using only a portion of the edge part of the opening of the top wall. Therefore, it is possible to increase the engaging strength upon the engagement with the lances 32, 42, without increasing plate thicknesses of the connection terminals.

Accordingly, it is possible to increase the engaging strength for preventing the disengagement between the lances 32, 42 of the connector housings 30, 40 and the connection terminals 10, 20 without thickening the connection terminals. Also, it is possible to improve the holding forces of the connection terminals 10, 20 in the connector housings 30, 40 at low cost.

Also, in the above illustrative embodiment, the female connection terminal 20 that is the female terminal and the male tab ten final 10 that is the male terminal have been described as the connection terminals having the hook-shaped lance engagement surfaces. In other words, it is possible to obtain the effect of improving the holding force in the connector housing by forming the lance engagement surface into the hook shape, irrespective of whether the connection terminal is the female or male terminal. Therefore, it is possible to increase the engaging strength for preventing the disengagement between the lances of the connector housings and the connection terminals and to improve the holding forces of the connection terminals in the connector housings, without thickening the connection terminals, irrespective of whether the connection terminal is the female or male terminal.

In the meantime, the invention is not limited to the above illustrative embodiment and appropriate modifications and improvements are made. Also, the materials, shapes, sizes, the number, the arranging places and the like of the respective constitutional elements of the illustrative embodiment are arbitrary and are not limited insomuch as the invention is implemented.

For example, regarding the lance engagement surface, it is possible to further improve the holding force in the connector housing by further increasing an area of the second engagement surface contacting the projected part of the lance of the connector housing.

The invention has been specifically described with reference to the specific illustrative embodiment. However, it is apparent to one skilled in the art that a variety of changes and modifications may be made without departing the spirit and scope of the invention.

The application is based on a Japanese Patent Application No. 2011-075926 filed on Mar. 30, 2011, the contents thereof being incorporated herein by reference.

INDUSTRIAL APPLICABILITY

According to the connection terminal of the invention, the lance engagement surface has the hook shape. Compared to the connection terminal of the related art having the linear lance engagement surface, the contact area with the projected part of the lance is increased and the mechanical strength is also improved by the hook shape structure. Therefore, the connection terminal of the invention increases the engaging strength upon the engagement with the lance, without increasing the plate thickness of the connection terminal.

REFERENCE SIGNS LIST

1: connector
10: male tab terminal (connection terminal)
11: tab
16: lance engagement hole (second lance engagement part)
16*a*: lance engagement surface
20: female connection terminal (connection terminal)
21: terminal fitting part
23: lance engagement hole (lance engagement part)
23*a*: lance engagement surface
30: female housing (first housing)
31: female terminal accommodation hole
32: female terminal engagement lance
32*b*: projected part
40: male housing (second housing)
41: male terminal accommodation hole
42: male terminal engagement lance
42*b*: projected part
161: first engagement surface
162: second engagement surface
231: first engagement surface
232: second engagement surface

The invention claimed is:

1. A combination of a connection terminal and a connector housing which receives the connection terminal, the combination comprising:

a terminal fitting part that fits with a leading end portion of a mating connection terminal;

a square tubular part that continues to a rear end of the terminal fitting part; and a lance engagement surface that is formed on the square tubular part and that, when the connection terminal is inserted into a terminal accommodation hole of the connector housing, is contacted to a projected part of a lance provided in the terminal accommodation hole to prevent the connection terminal from disengaging from the terminal accommodation hole, wherein the lance engagement surface is a hook-shaped engagement surface that is formed by an opening across a top wall of the square tubular part facing the lance and a sidewall part continuing to a side edge of the top wall and that comprises a first engagement surface which is an edge part of the opening of the top wall and a second engagement surface which is an edge part of the opening of the sidewall part and extends in a direction substantially orthogonal to the top wall from an end of the first engagement surface, and the first engagement surface and the second engagement surface are contacted to the projected part when the connection terminal is inserted in the terminal accommodation hole.

2. The combination of a connection terminal and a connector housing which receives the connection terminal according to claim 1, wherein the terminal fitting part has a square tubular structure to which a tab of the mating connection terminal is fittable.

3. The combination of a connection terminal and a connector housing which receives the connection terminal according to claim 1, wherein the terminal fitting part is a tab that is fittable to a terminal fitting part having a square tubular structure of the mating connection terminal.

* * * * *